US011882911B2

(12) United States Patent
Zhou

(10) Patent No.: US 11,882,911 B2
(45) Date of Patent: Jan. 30, 2024

(54) STEAM HAIR STRAIGHTENER

(71) Applicant: Yungang Zhou, Hubei (CN)

(72) Inventor: Yungang Zhou, Hubei (CN)

(73) Assignee: Dongguan KangRoad Electrical Technology Co., Ltd., Dongguan (CN)

( * ) Notice: Subject to any disclaimer, the term of this patent is extended or adjusted under 35 U.S.C. 154(b) by 365 days.

(21) Appl. No.: 17/239,543

(22) Filed: Apr. 23, 2021

(65) Prior Publication Data

US 2022/0007808 A1 Jan. 13, 2022

(30) Foreign Application Priority Data

Jul. 10, 2020 (CN) ..... 202021362111.4
Sep. 28, 2020 (CN) ..... 202011046890.1

(51) Int. Cl.
*A45D 2/00* (2006.01)
*A45D 1/00* (2006.01)

(52) U.S. Cl.
CPC ..... *A45D 2/001* (2013.01); *A45D 2001/008* (2013.01)

(58) Field of Classification Search
CPC . A45D 1/00; A45D 1/008; A45D 1/04; A45D 1/06; A45D 1/08; A45D 1/14; A45D 1/28; A45D 2/00; A45D 2/001; A45D 19/16
See application file for complete search history.

(56) References Cited

U.S. PATENT DOCUMENTS

2012/0312319 A1* 12/2012 Uwano ..... A45D 2/001 132/211
2017/0013931 A1* 1/2017 Chen ..... A45D 19/16

* cited by examiner

*Primary Examiner* — Cris L. Rodriguez
*Assistant Examiner* — Karim Asqiriba

(57) ABSTRACT

The invention discloses a steam hair straightener, comprising an upper handle and an upper cover forming the upper part, and a lower handle and a lower cover forming the lower part, wherein the upper handle and the upper cover are assembled and fixed by screws, and a first installation cavity is formed there between; the lower handle and the lower cover are also assembled and fixed by screws, and a second installation cavity is formed there between; the inside of the first installation cavity is equipped with an upper heating plate, a hot steam device, a water tank and a water pump; the second installation cavity is equipped with a lower heating plate, an infrared device, a function control board, and a 360° rotating power cord; the hot steam device is installed on the upper heating plate.

10 Claims, 7 Drawing Sheets

STEAM HAIR STRAIGHTENER

FIELD OF THE INVENTION

The invention relates to the technical field of hair straighteners, in particular to a steam hair straightener.

BACKGROUND OF THE INVENTION

Hair straightener is also called electric splint, and the English name is hair straightener, which is commonly called splints. It heats the heating element MCH or PTC or heating wire of the hair straightener through electric current, and conducts heat to the aluminum plate or ceramic plate. With the improvement of people's material level, beauty salons and hairdressing have become a major consumer area. As a common hairdressing tool, hair straighteners can be used to straighten hair, and are favored by young consumer groups.

Current hair straighteners have relatively simple functions and lack of internal steam, which can easily cause problems such as dry, fragile, tangled, and scalded hair after straightening, and the experience of other functions is also poor.

SUMMARY OF THE INVENTION

The technical problem to be solved by the invention is to provide a steam hair straightener to solve the problems raised in the background art.

The invention is realized by the following technical solutions: a steam hair straightener, comprising an upper handle and an upper cover forming the upper part, and a lower handle and a lower cover forming the lower part, wherein the upper handle and the upper cover are assembled and fixed by screws, and a first installation cavity is formed therebetween; the lower handle and the lower cover are also assembled and fixed by screws, and a second installation cavity is formed therebetween; the inside of the first installation cavity is equipped with an upper heating plate, a hot steam device, a water tank and a water pump; the second installation cavity is equipped with a lower heating plate, an infrared device, a function control board, and a 360° rotating power cord; the hot steam device is installed on the upper heating plate; the water pump is installed at the lower end of the water tank; the output end of the water pump is connected to the steam device, and the input end of the water pump is connected to the water tank; the surfaces of the upper cover and the lower cover are respectively provided with at least one screw hole for assembling and fixing, and each screw hole is respectively provided with a lower cover screw cover and an upper cover screw cover for sealing.

Preferably, the water tank comprises a water tank upper cover, a water tank lower cover, and a one-way valve; the water tank upper cover and the water tank lower cover are integrally formed; a sealing ring is installed around the joint between the water tank upper cover and the water tank lower cover; the upper end of the water tank is provided with a water inlet hole; the upper handle is provided with a water inlet just opposite a first water inlet hole; the water inlet is equipped with a tank cover sealing ring and a water tank cover; the water inlet and the water inlet hole are in sealed connection; the water inlet hole is equipped with a one-way valve, and a one-way valve fixing piece and a rubber ring are installed between the one-way valve and the water inlet hole; the bottom surface of the water tank lower cover is recessed inward to form an assembly groove matching the water pump; the water pump is installed in the assembly groove; the inlet end of the water pump is connected to the inside of the water tank, and the outlet end of the water pump is connected with a water inlet pipe; one end of the water inlet pipe is connected to the hot steam device on the heating plate.

Preferably, the hot steam device is installed inside the upper heating plate and inside the lower heating plate; the hot steam device comprises a steam pressing sheet and an insulating sleeve sealing ring; the steam pressing sheet is installed inside an insulation sleeve; the insulating sleeve sealing ring is installed on the upper end of the steam pressing sheet; the inside of the insulating sleeve sealing ring is provided with a strip-shaped steam sealing ring, and the heating plate is provided with a through hole communicating with the steam pressing sheeting sheet; the water pumped by the water pump is in contact with the steam pressing sheet along the through hole.

Preferably, the upper heating plate comprises an upper heating plate mica sheet, an upper insulating sleeve, an MCH elastic piece, an MCH pressing sheet, an MCH, and a combined heating plate; the lower heating plate comprises a lower heating plate mica sheet, a lower front insulating sleeve, a lower rear insulating sleeve, an MCH elastic piece, an MCH pressing sheet, an MCH, a lower left heating plate, and a lower right heating plate; the upper heating plate and the lower heating plate are respectively arranged at one end close to the upper cover and the lower cover; the upper heating plate mica sheet and the lower heating plate mica sheet are respectively arranged at one end close to the upper insulating sleeve and the lower front insulating sleeve; the upper insulating sleeve and the lower front insulating sleeve are respectively arranged at one end close to the upper handle and the lower handle, and the lower rear insulating sleeve is arranged at the other end close to the lower handle; the MCH elastic piece, the MCH pressing piece, and the MCH are all arranged between the insulating sleeve and the heating plate, and are assembled and sealed in the middle.

Preferably, a shell assembly is formed between the insulating sleeve and the heating plate; the heating plate covers the outside of the steam sealing ring and the two sets of heating components, and the middle of the heating plate is provided with more than one steam hole; steam is ejected from the middle of the heating plate; a water outlet screen is provided outside the steam hole between the heating plate and the insulating sleeve; the water outlet screen is provided with more than one group of micro-hole groups; the water outlet screen is fixed by the steam pressing sheet; the surface of the steam pressing sheet is provided with a high temperature resistant nylon cloth.

Preferably, the combined heating plate, the lower left heating plate and the lower right heating plate all comprise a heating element, a heat conducting part, a heating plate, and a heating plate bracket; the heating plate bracket is installed and fixed with the heating plate; the heat conducting part is used to connect the heating plate and the heating element; the heating plate is provided with curved parts, and the curved parts are arranged on both sides of the heating plate; the heat conducting part is solid thermal conductive silicone grease; the heat conducting part is in close contact with the heating plate and the heating element; the heating element is an integrated heating element.

Preferably, the infrared device is installed at the lower end of the lower heating plate; a silica gel for buffering is provided between the infrared device and the lower handle; the infrared device comprises a first circuit board installed with an infrared lamp, an infrared sealing block, an iron sheet, a fuse pressing sheet, a fuse, a glass, and a glass sealing ring; the first circuit board, the fuse pressing sheet, the fuse, and the glass are assembled and sealed inside by the infrared sealing block and the iron sheet, and the outside of the glass is equipped with the glass sealing ring.

Preferably, a sealing block is installed between the lower heating plate and the function control board; the function control board comprises a second circuit board, and a switch button and a gear button installed on the surface of the second circuit board and used to control heat generation; an upper and lower handle closing lock device is installed between the upper cover plate and the lower cover plate; the upper and lower handle closing lock device comprises a push lock and a lock; the upper cover plates and the lower cover plate are opened and closed by the push lock and the lock.

Preferably, the 360° rotating power cord is installed at the tail of the hair straightener and electrically connected to the function control board; the 360° rotating power cord comprises a power cord, a lock ring, a tail rotating sleeve, a rotating shaft, a junction box cover, and a rear cover; one end of the power cord is connected to the tail rotating sleeve; the lock ring is installed between the power cord and the tail rotating sleeve; the other end of the tail rotating sleeve is electrically connected to the function control board; the junction box cover and the rear cover are installed on the upper end of the lock ring, and are connected to the hair straightener through the rotating shaft.

Preferably, the tail of the hair straightener is provided with a left side cover and a right side cover; a third installation cavity is formed between the left side cover and the right side cover, and the lock ring, the tail rotating sleeve, the rotating shaft, the junction box cover, the push lock, and the lock are all installed inside the third installation cavity.

The advantageous effects of the invention are:

1. the water tank is built-in, the internal space utilization of the structure is high, and at the same time, it overcomes the troublesome operation caused by external water supply;
2. it has built-in infrared heat gathering and automatic steam mode;
3. the design of steam flow channel is conducive to more complete vaporization of steam;
4. the operation is facilitated by the fully automatic water pump, which eliminates the need for manual extrusion.

BRIEF DESCRIPTION OF THE DRAWINGS

In order to explain the embodiments of the invention or the technical solutions in the prior art more clearly, the drawings that need to be used in the description of the embodiments or the prior art will be introduced hereinafter. Obviously, the drawings in the following description are only some embodiments of the invention. For those of ordinary skill in the art, other drawings may be obtained from these drawings without creative efforts.

Figure 1:
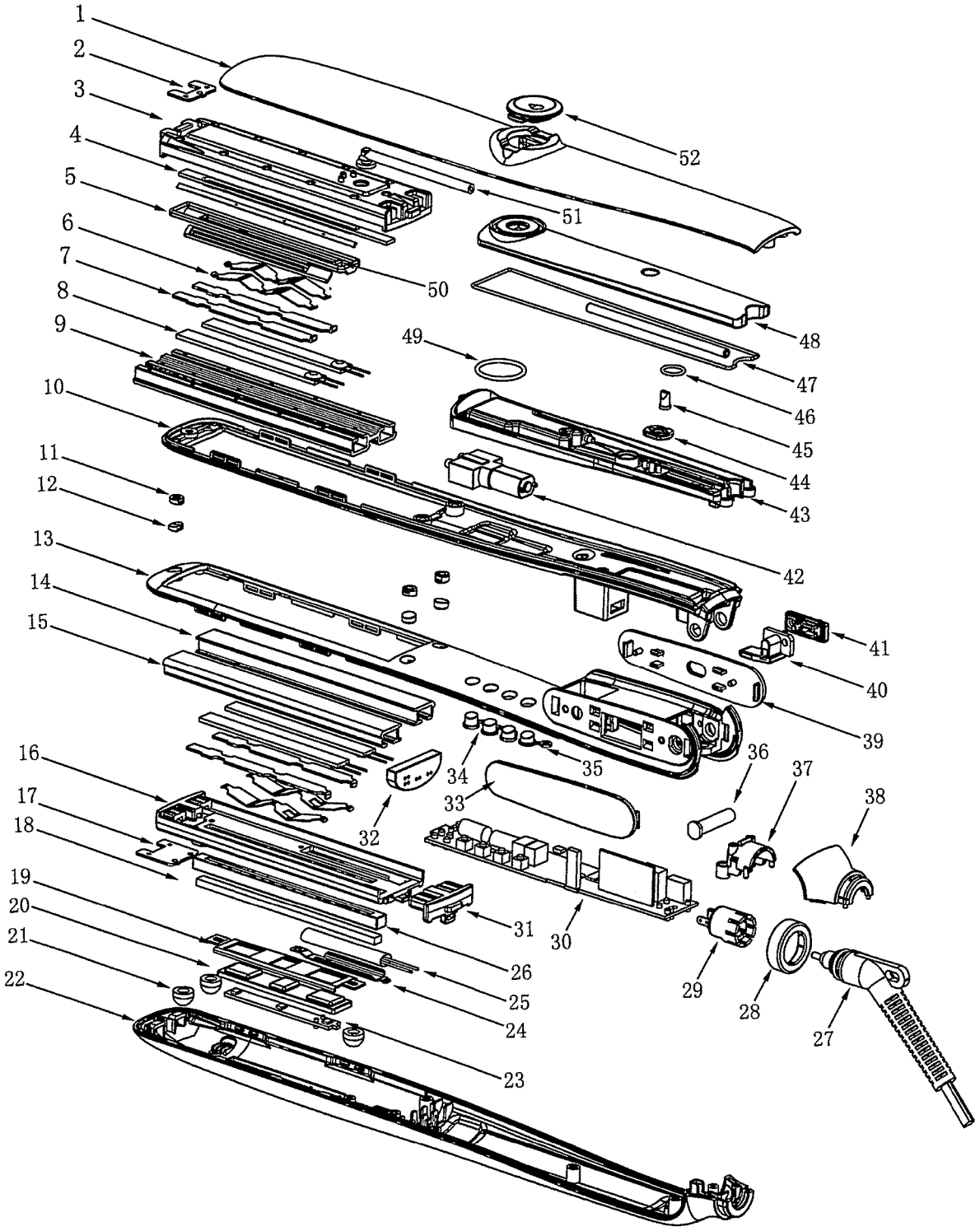
FIG. 1 is an exploded view of the invention.
Figure 2:
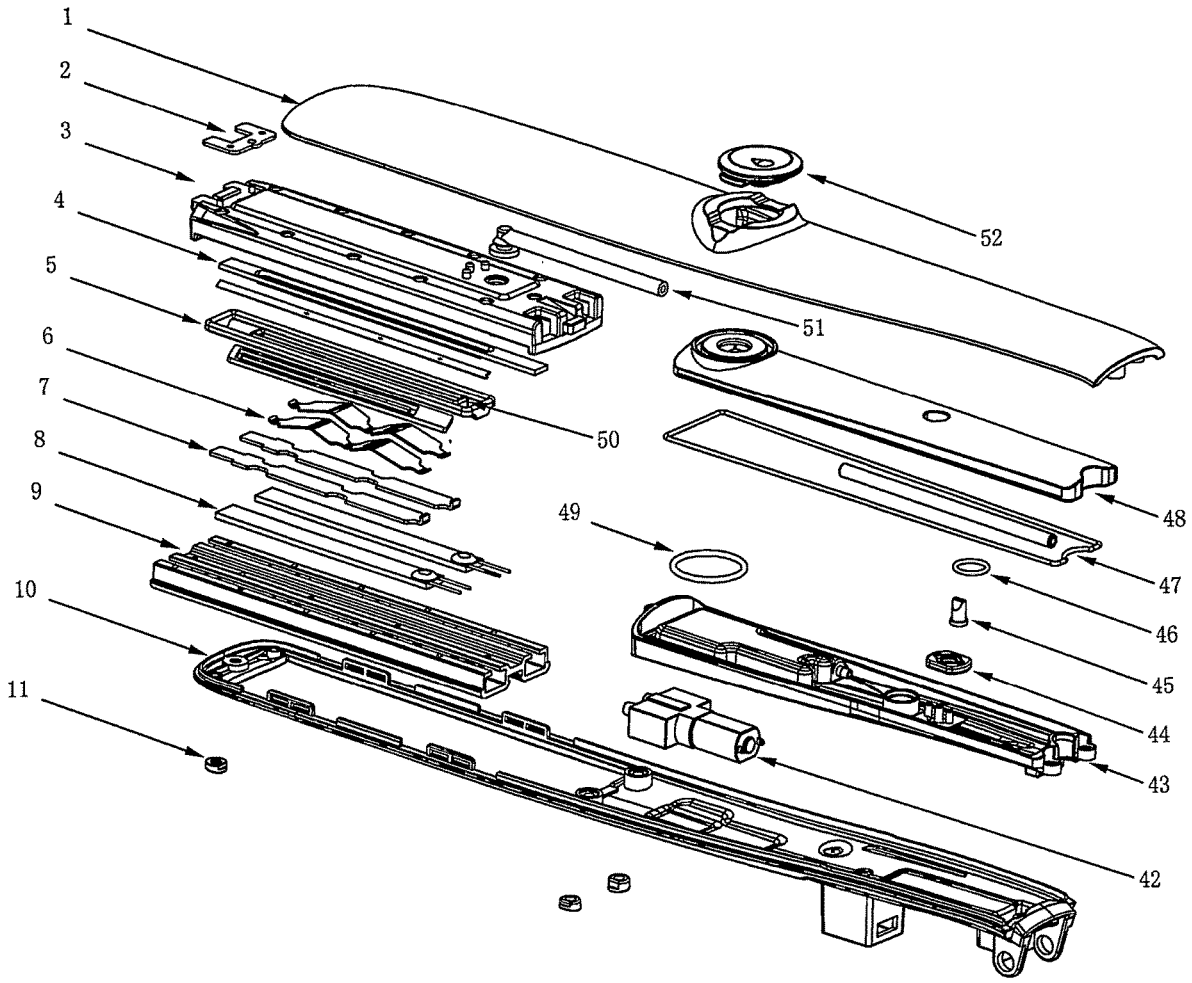
FIG. 2 is an exploded view of the upper part of the invention.
Figure 3:
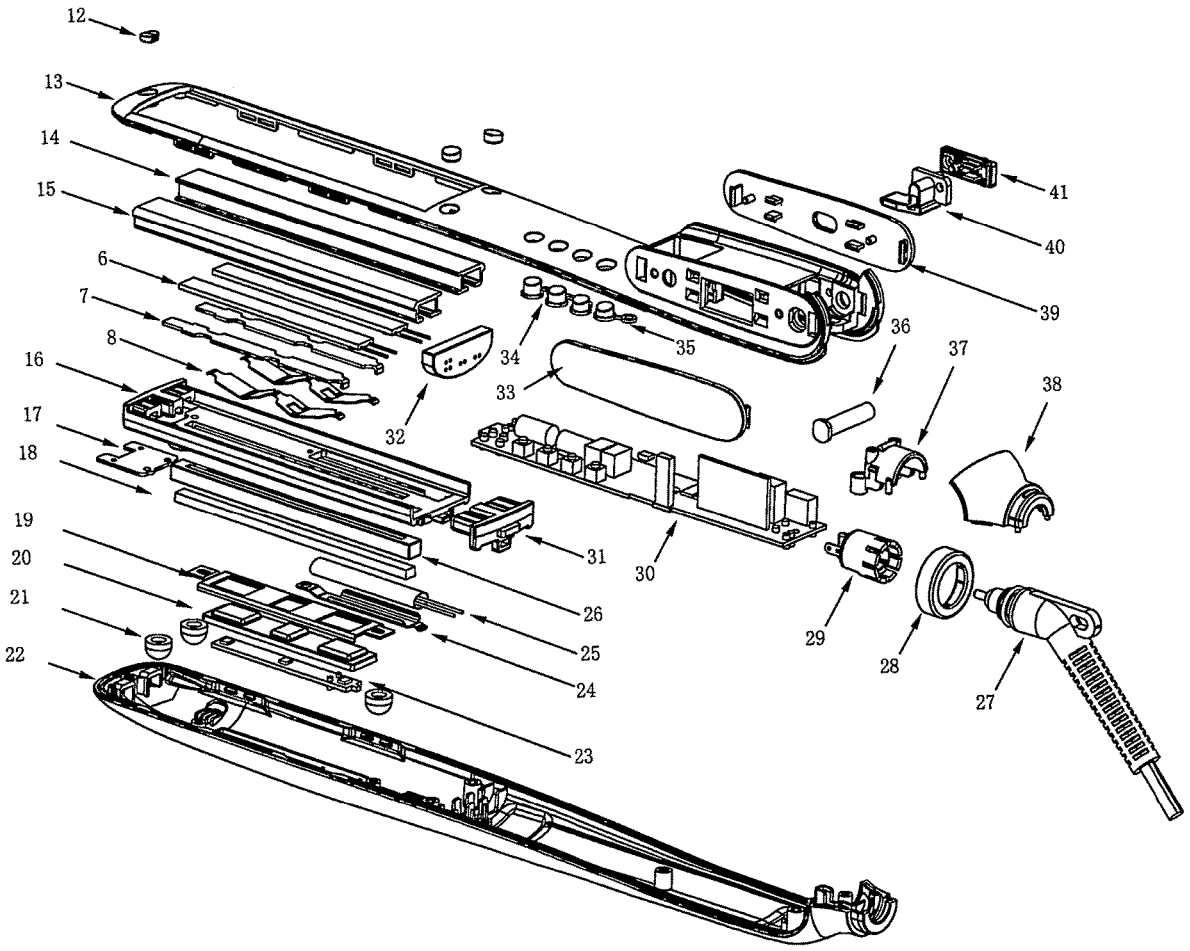
FIG. 3 is an exploded view of the upper part of the invention.
Figure 4:
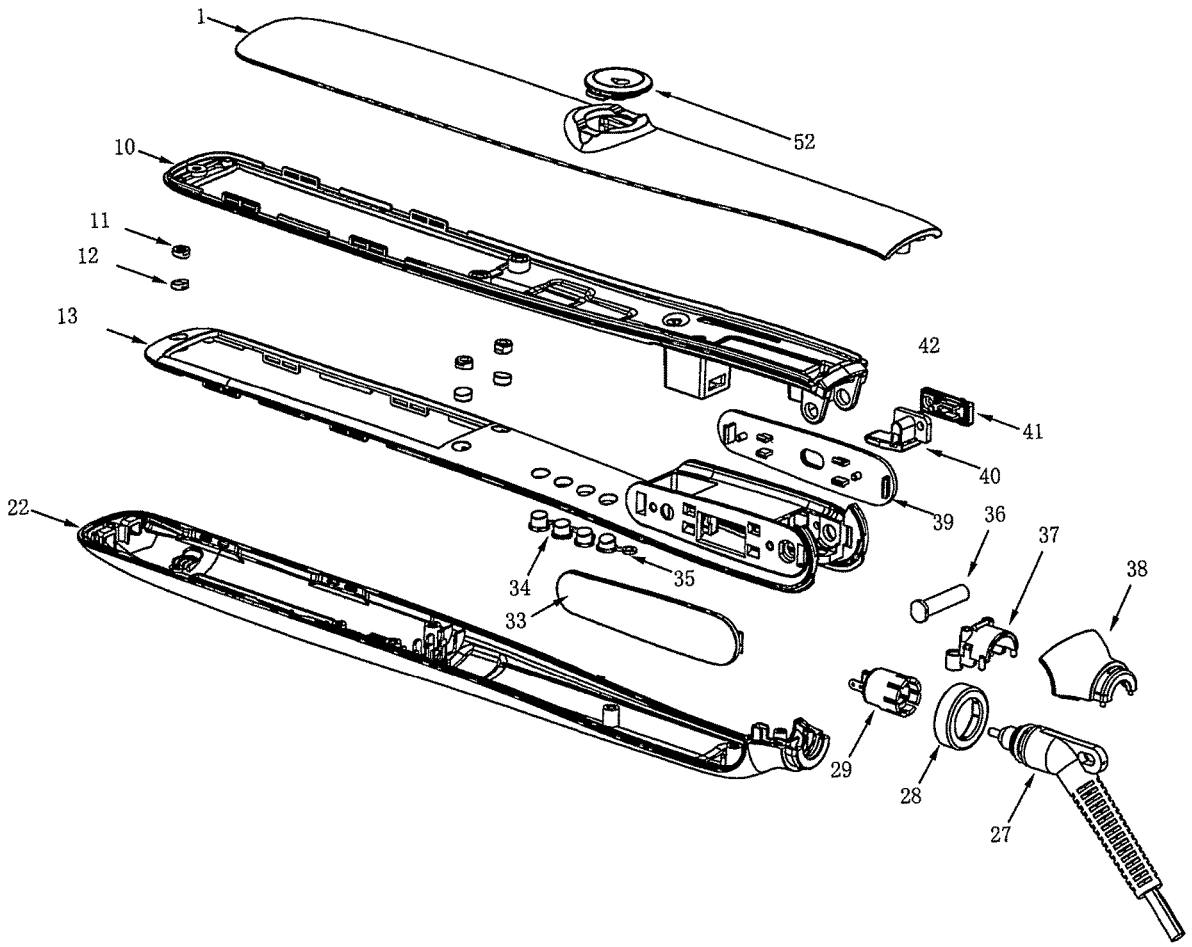
FIG. 4 is a split view of the outer shell of the invention.

In the figures, 1 refers to the upper handle; 2 refers to the upper heating plate mica sheet; 3 refers to the upper insulating sleeve; 4 refers to the steam pressing sheet; 5 refers to the insulating sleeve sealing ring; 6 refers to the MCH elastic piece; 7 refers to the MCH pressing sheet; 8 refers to the MCH; 9 refers to the combined heating plate; 10 refers to the upper cover; 11 refers to the lower cover screw cover; 12 refers to the upper cover screw cover; 13 refers to the lower cover; 14 refers to the lower left heating plate; 15 refers to the lower right heating plate; 16 refers to the lower front insulating sleeve; 17 refers to the lower heating plate mica sheet; 18 refers to the glass; 19 refers to the iron sheet; 20 refers to the infrared sealing block; 21 refers to the silica gel; 22 refers to the lower handle; 23 refers to the first circuit board; 24 refers to the fuse pressing sheet; 25 refers to the fuse; 26 refers to the glass sealing block; 27 refers to the power cord; 28 refers to the lock ring; 29 refers to the tail rotating sleeve; 30 refers to the second circuit board; 31 refers to the lower rear insulating sleeve; 32 refers to the sealing block; 33 refers to the left side cover; 34 refers to the gear button; 35 refers to the switch button; 36 refers to the rotating shaft; 37 refers to the junction box cover; 38 refers to the rear cover; 39 refers to the right side cover; 40 refers to the lock; 41 refers to the push lock; 42 refers to the water pump; 43 refers to the water tank lower cover; 44 refers to the one-way valve fixing piece; 45 refers to the one-way valve; 46 refers to the rubber ring; 47 refers to the sealing ring; 48 refers to the water tank upper cover; 49 refers to the tank cover sealing ring; 50 refers to the steam sealing ring; 51 refers to the water inlet pipe; 52 refers to the water tank cover.

DETAILED DESCRIPTION OF THE PREFERRED EMBODIMENTS

The embodiments of the invention will be described in detail hereinafter. Examples of the embodiments are shown in the accompanying drawings, wherein the same or similar reference numerals indicate the same or similar elements or elements with the same or similar functions.

In the description of the invention, it should be understood that the orientation or positional relationship indicated by the terms "center", "upper", "lower", "front", "back", "left", "right", "vertical", "horizontal", "top", "bottom", "inner", "outer" etc. are based on the orientation or positional relationship shown in the drawings, and is only for the convenience of describing the invention and simplifying the description, but do not indicate or imply that the pointed device or element must have a specific orientation and be configured and operated in a specific orientation, and therefore cannot be understood as a limitation of the invention.

In the description of the invention, it should be noted that the terms "installed", "connected" and "set" should be understood in a broad sense, unless otherwise clearly defined and limited. For example, it may be fixedly connected or arranged, or detachably connected or arranged, or integrally connected or arranged. For those of ordinary skill in the art, the specific meanings of the above terms in the invention can be understood in specific situations.

As shown in FIG. 1-4, a steam hair straightener of the invention, comprising an upper handle 1 and an upper cover 10 forming the upper part, and a lower handle 22 and a lower cover 13 forming the lower part, wherein the upper handle 1 and the upper cover 10 are assembled and fixed by screws, and a first installation cavity is formed therebetween; the lower handle 22 and the lower cover 13 are also assembled and fixed by screws, and a second installation cavity is formed therebetween; the inside of the first installation cavity is equipped with an upper heating plate, a hot steam device, a water tank and a water pump 42; the second installation cavity is equipped with a lower heating plate, an infrared device, a function control board, and a 360° rotating power cord; the hot steam device is installed on the upper heating plate; the water pump 42 is installed at the lower end of the water tank; the output end of the water pump 42 is connected to the steam device, and the input end of the water pump 42 is connected to the water tank; the surfaces of the upper cover 10 and the lower cover 13 are respectively provided with at least one screw hole for assembling and fixing, and each screw hole is respectively provided with a lower cover screw cover 11 and an upper cover screw cover 12 for sealing.

Figure 5:
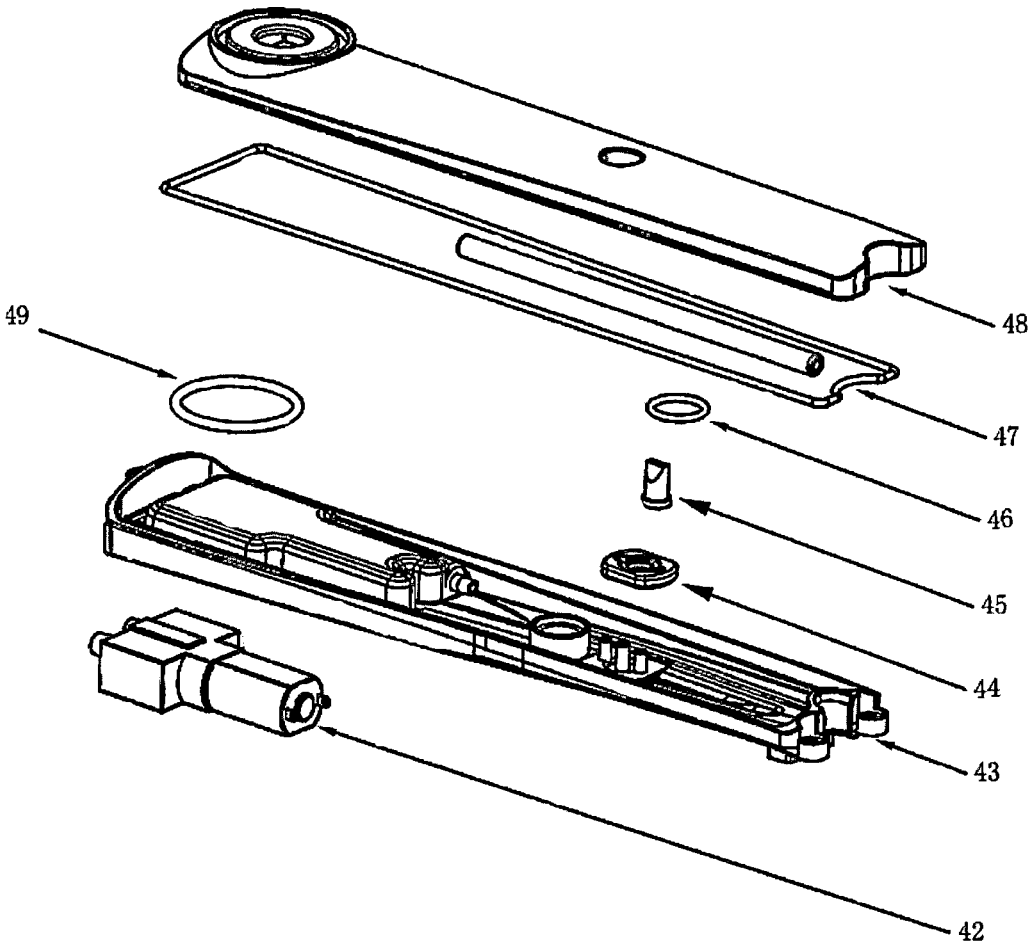
FIG. 5 is a split view of the water tank of the invention.

As shown in FIG. 5, the water tank comprises a water tank upper cover 48, a water tank lower cover 43, and a one-way valve 45; the water tank upper cover 48 and the water tank lower cover 43 are integrally formed; a sealing ring 47 is installed around the joint between the water tank upper cover 48 and the water tank lower cover 43; the upper end of the water tank is provided with a water inlet hole; the upper handle is provided with a water inlet just opposite a first water inlet hole; the water inlet is equipped with a tank cover sealing ring 49 and a water tank cover 52; the water inlet and the water inlet hole are in sealed connection; the water inlet hole is equipped with a one-way valve 45, and a one-way valve fixing piece 44 and a rubber ring 46 are installed between the one-way valve 45 and the water inlet hole; the bottom surface of the water tank lower cover 43 is recessed inward to form an assembly groove matching the water pump; the water pump 42 is installed in the assembly groove; the inlet end of the water pump 42 is connected to the inside of the water tank, and the outlet end of the water pump 42 is connected with a water inlet pipe 51; one end of the water inlet pipe 51 is connected to the hot steam device on the heating plate.

Figure 6:
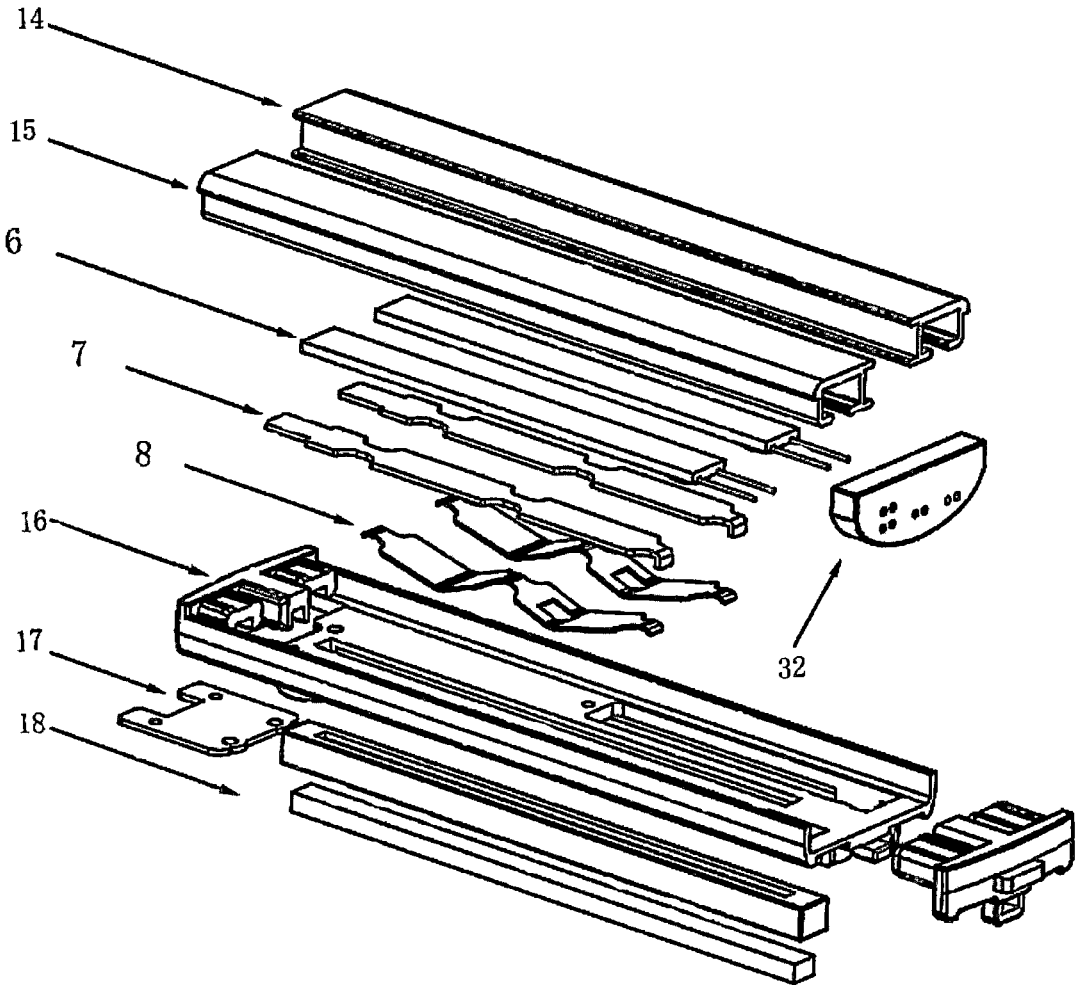
FIG. 6 is a split view of the upper heating plate and the hot steam device of the invention.
Figure 7:
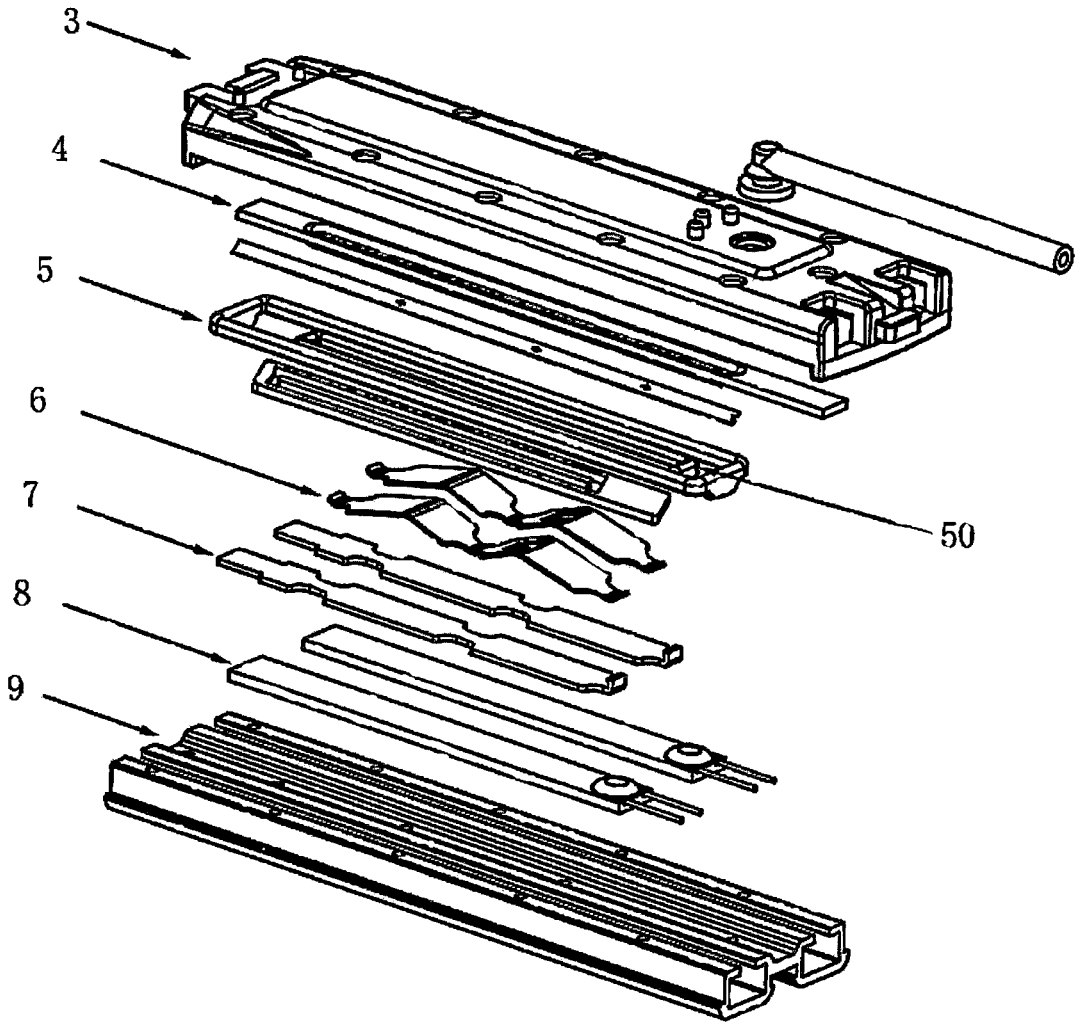
FIG. 7 is a split view of the lower heating plate and the hot steam device of the invention.

As shown in FIG. 6-7, the hot steam device is installed inside the upper heating plate and inside the lower heating plate; the hot steam device comprises a steam pressing sheet 4 and an insulating sleeve sealing ring 5; the steam pressing sheet 4 is installed inside an insulation sleeve; the insulating sleeve sealing ring 5 is installed on the upper end of the steam pressing sheet 4; the inside of the insulating sleeve sealing ring 5 is provided with a strip-shaped steam sealing ring 50, and the heating plate is provided with a through hole communicating with the steam pressing sheeting sheet 4; the water pumped by the water pump 42 is in contact with the steam pressing sheet along the through hole.

The upper heating plate comprises an upper heating plate mica sheet 2, an upper insulating sleeve 3, an MCH elastic piece 6, an MCH pressing sheet 7, an MCH 8, and a combined heating plate 9; the lower heating plate comprises a lower heating plate mica sheet 17, a lower front insulating sleeve 16, a lower rear insulating sleeve 31, an MCH elastic piece 6, an MCH pressing sheet 7, an MCH 8, a lower left heating plate 14, and a lower right heating plate 15; the upper heating plate and the lower heating plate are respectively arranged at one end close to the upper cover and the lower cover; the upper heating plate mica sheet 2 and the lower heating plate mica sheet 17 are respectively arranged at one end close to the upper insulating sleeve 3 and the lower front insulating sleeve 16; the upper insulating sleeve 3 and the lower front insulating sleeve 16 are respectively arranged at one end close to the upper handle 1 and the lower handle 22, and the lower rear insulating sleeve 31 is arranged at the other end close to the lower handle 22; the MCH elastic piece 6, the MCH pressing piece 7, and the MCH 8 are all arranged between the insulating sleeve and the heating plate, and are assembled and sealed in the middle.

A shell assembly is formed between the insulating sleeve and the heating plate; the heating plate covers the outside of the steam sealing ring 6 and the two sets of heating components, and the middle of the heating plate is provided with more than one steam hole; steam is ejected from the middle of the heating plate; a water outlet screen is provided outside the steam hole between the heating plate and the insulating sleeve; the water outlet screen is provided with more than one group of micro-hole groups; the water outlet screen is fixed by the steam pressing sheet 4; the surface of the steam pressing sheet 4 is provided with a high temperature resistant nylon cloth.

The combined heating plate 9, the lower left heating plate 14 and the lower right heating plate 15 all comprise a heating element, a heat conducting part, a heating plate, and a heating plate bracket; the heating plate bracket is installed and fixed with the heating plate; the heat conducting part is used to connect the heating plate and the heating element; the heating plate is provided with curved parts, and the curved parts are arranged on both sides of the heating plate; the heat conducting part is solid thermal conductive silicone grease; the heat conducting part is in close contact with the heating plate and the heating element; the heating element is an integrated heating element.

The infrared device is installed at the lower end of the lower heating plate; a silica gel 21 for buffering is provided between the infrared device and the lower handle 22; the infrared device comprises a first circuit board 23 installed with an infrared lamp, an infrared sealing block 20, an iron sheet 19, a fuse pressing sheet 24, a fuse 25, a glass 18, and a glass sealing ring 26; the first circuit board 23, the fuse pressing sheet 24, the fuse 25, and the glass 18 are assembled and sealed inside by the infrared sealing block 20 and the iron sheet 19, and the outside of the glass 18 is equipped with the glass sealing ring 26.

A sealing block 32 is installed between the lower heating plate and the function control board; the function control board comprises a second circuit board 30, and a switch button 35 and a gear button 34 installed on the surface of the second circuit board 30 and used to control heat generation; an upper and lower handle closing lock device is installed between the upper cover plate and the lower cover plate; the upper and lower handle closing lock device comprises a push lock 41 and a lock 40; the upper cover plates and the lower cover plate are opened and closed by the push lock 41 and the lock 40.

The 360° rotating power cord is installed at the tail of the hair straightener and electrically connected to the function control board; the 360° rotating power cord comprises a power cord 27, a lock ring 28, a tail rotating sleeve 29, a rotating shaft 36, a junction box cover 37, and a rear cover 38; one end of the power cord 27 is connected to the tail rotating sleeve 29; the lock ring 28 is installed between the power cord 27 and the tail rotating sleeve 29; the other end of the tail rotating sleeve 29 is electrically connected to the function control board; the junction box cover 37 and the rear cover 38 are installed on the upper end of the lock ring 28, and are connected to the hair straightener through the rotating shaft 36.

The tail of the hair straightener is provided with a left side cover 33 and a right side cover 39; a third installation cavity is formed between the left side cover 33 and the right side cover 39, and the lock ring 28, the tail rotating sleeve 29, the rotating shaft 36, the junction box cover 37, the push lock 41, and the lock 40 are all installed inside the third installation cavity.

The above are only specific embodiments of the invention, but the protection scope of the invention is not limited thereto. Any modifications or substitutions creative efforts shall all fall within protection scope of the invention. Therefore, the protection scope of the invention should be subject to the protection scope defined by the claims.

What is claimed is:

1. A steam hair straightener, comprising an upper handle (1) and an upper cover (10) forming an upper part, and a lower handle (22) and a lower cover (13) forming a lower part, wherein the upper handle (1) and the upper cover (10) are assembled and fixed by screws, and a first installation cavity is formed therebetween; the lower handle (22) and the lower cover (13) are also assembled and fixed by screws, and a second installation cavity is formed therebetween; an inside of the first installation cavity is equipped with an upper heating plate, a hot steam device, a water tank and a water pump (42); the second installation cavity is equipped with a lower heating plate, an infrared device, a function control board, and a 360° rotating power cord; the hot steam device is installed on the upper heating plate; the water pump (42) is installed at the lower end of the water tank; an output end of the water pump (42) is connected to the steam device, and an input end of the water pump (42) is connected to the water tank; the surfaces of the upper cover (10) and the lower cover (13) are respectively provided with at least one screw hole for assembling and fixing, and each screw hole is respectively provided with a lower cover screw cover (11) and an upper cover screw cover (12) for sealing.

2. The steam hair straightener according to claim 1, wherein the water tank comprises a water tank upper cover (48), a water tank lower cover (43), and a one-way valve (45); the water tank upper cover (48) and the water tank lower cover (43) are integrally formed; a sealing ring (47) is installed around a joint between the water tank upper cover (48) and the water tank lower cover (43); the upper end of the water tank is provided with a water inlet hole; the upper handle is provided with a water inlet just opposite a first water inlet hole; the water inlet is equipped with a tank cover sealing ring (49) and a water tank cover (52); the water inlet and the water inlet hole are in sealed connection; the water inlet hole is equipped with a one-way valve (45), and a one-way valve fixing piece (44) and a rubber ring (46) are installed between the one-way valve (45) and the water inlet hole; the bottom surface of the water tank lower cover (43) is recessed inward to form an assembly groove matching the water pump; the water pump (42) is installed in the assembly groove; the inlet end of the water pump (42) is connected to the inside of the water tank, and the outlet end of the water pump (42) is connected with a water inlet pipe (51); one end of the water inlet pipe (51) is connected to the hot steam device on the heating plate.

3. The steam hair straightener according to claim 1, wherein the hot steam device is installed inside the upper heating plate and inside the lower heating plate; the hot steam device comprises a steam pressing sheet (4) and an insulating sleeve sealing ring (5); the steam pressing sheet (4) is installed inside an insulation sleeve; the insulating sleeve sealing ring (5) is installed on the upper end of the steam pressing sheet (4); the inside of the insulating sleeve sealing ring (5) is provided with a strip-shaped steam sealing ring (50), and the heating plate is provided with a through hole communicating with the steam pressing sheeting sheet (4); the water pumped by the water pump (42) is in contact with the steam pressing sheet along the through hole.

4. The steam hair straightener according to claim 3, wherein the upper heating plate comprises an upper heating plate mica sheet (2), an upper insulating sleeve (3), an MCH elastic piece (6), an MCH pressing sheet (7), an MCH (8), and a combined heating plate (9); the lower heating plate comprises a lower heating plate mica sheet (17), a lower front insulating sleeve (16), a lower rear insulating sleeve (31), an MCH elastic piece (6), an MCH pressing sheet (7), an MCH (8), a lower left heating plate (14), and a lower right heating plate (15); the upper heating plate and the lower heating plate are respectively arranged at one end close to the upper cover and the lower cover; the upper heating plate mica sheet (2) and the lower heating plate mica sheet (17) are respectively arranged at one end close to the upper insulating sleeve (3) and the lower front insulating sleeve (16); the upper insulating sleeve (3) and the lower front insulating sleeve (16) are respectively arranged at one end close to the upper handle (1) and the lower handle (22), and the lower rear insulating sleeve (31) is arranged at the other end close to the lower handle (22); the MCH elastic piece (6), the MCH pressing piece (7), and the MCH (8) are all arranged between the insulating sleeve and the heating plate, and are assembled and sealed in the middle.

5. The steam hair straightener according to claim 4, wherein a shell assembly is formed between the insulating sleeve and the heating plate; the heating plate covers the outside of the steam sealing ring (6) and the two sets of heating components, and the middle of the heating plate is provided with more than one steam hole; steam is ejected from the middle of the heating plate; a water outlet screen is provided outside the steam hole between the heating plate and the insulating sleeve; the water outlet screen is provided with more than one group of micro-hole groups; the water outlet screen is fixed by the steam pressing sheet (4); the surface of the steam pressing sheet (4) is provided with a high temperature resistant nylon cloth.

6. The steam hair straightener according to claim 4, wherein the combined heating plate (9), the lower left heating plate (14) and the lower right heating plate (15) all comprise a heating element, a heat conducting part, a heating plate, and a heating plate bracket; the heating plate bracket is installed and fixed with the heating plate; the heat conducting part is used to connect the heating plate and the heating element; the heating plate is provided with curved parts, and the curved parts are arranged on both sides of the heating plate; the heat conducting part is solid thermal conductive silicone grease; the heat conducting part is in close contact with the heating plate and the heating element; the heating element is an integrated heating element.

7. The steam hair straightener according to claim 1, wherein the infrared device is installed at the lower end of the lower heating plate; a silica gel (21) for buffering is provided between the infrared device and the lower handle (22); the infrared device comprises a first circuit board (23) installed with an infrared lamp, an infrared sealing block (20), an iron sheet (19), a fuse pressing sheet (24), a fuse (25), a glass (18), and a glass sealing ring (26); the first circuit board (23), the fuse pressing sheet (24), the fuse (25), and the glass (18) are assembled and sealed inside by the infrared sealing block (20) and the iron sheet (19), and the outside of the glass (18) is equipped with the glass sealing ring (26).

8. The steam hair straightener according to claim 1, wherein a sealing block (32) is installed between the lower heating plate and the function control board; the function control board comprises a second circuit board (30), and a switch button (35) and a gear button (34) installed on the surface of the second circuit board (30) and used to control heat generation; an upper and lower handle closing lock device is installed between the upper cover plate and the lower cover plate; the upper and lower handle closing lock device comprises a push lock (41) and a lock (40); the upper cover plates and the lower cover plate are opened and closed by the push lock (41) and the lock (40).

9. The steam hair straightener according to claim 8, wherein the 360° rotating power cord is installed at the tail of the hair straightener and electrically connected to the function control board; the 360° rotating power cord comprises a power cord (27), a lock ring (28), a tail rotating sleeve (29), a rotating shaft (36), a junction box cover (37), and a rear cover (38); one end of the power cord (27) is connected to the tail rotating sleeve (29); the lock ring (28) is installed between the power cord (27) and the tail rotating sleeve (29); the other end of the tail rotating sleeve (29) is electrically connected to the function control board; the junction box cover (37) and the rear cover (38) are installed on the upper end of the lock ring (28), and are connected to the hair straightener through the rotating shaft (36).

10. The steam hair straightener according to claim 9, wherein the tail of the hair straightener is provided with a left side cover (33) and a right side cover (39); a third installation cavity is formed between the left side cover (33) and the right side cover (39), and the lock ring (28), the tail rotating sleeve (29), the rotating shaft (36), the junction box cover (37), the push lock (41), and the lock (40) are all installed inside the third installation cavity.

* * * * *